US012139675B1

(12) United States Patent
Koseoglu

(10) Patent No.: US 12,139,675 B1
(45) Date of Patent: Nov. 12, 2024

(54) PROCESSES FOR PROLONGING CATALYST ACTIVITY IN A HYDROPROCESSING UNIT

(71) Applicant: SAUDI ARABIAN OIL COMPANY, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/310,212

(22) Filed: May 1, 2023

(51) Int. Cl.
*C10G 65/14* (2006.01)

(52) U.S. Cl.
CPC ..... *C10G 65/14* (2013.01); *C10G 2300/4081* (2013.01); *C10G 2300/701* (2013.01)

(58) Field of Classification Search
CPC ..... C10G 65/14; C10G 2300/4081; C10G 2300/701
See application file for complete search history.

(56) References Cited

U.S. PATENT DOCUMENTS

| | | | |
|---|---|---|---|
| 2,956,005 | A | 10/1960 | Lutz et al. |
| 3,900,390 | A | 8/1975 | Adams et al. |
| 4,992,607 | A | 2/1991 | Harandi et al. |
| 5,445,728 | A | 8/1995 | Sherwood, Jr. et al. |
| 6,123,833 | A | 9/2000 | Sechrist et al. |
| 6,974,842 | B1 | 12/2005 | Spena et al. |
| 7,615,142 | B2 | 11/2009 | Lee et al. |
| H2244 | H | 8/2010 | Clay et al. |
| 8,435,400 | B2 | 5/2013 | Kou et al. |
| 9,096,806 | B2 | 8/2015 | Abba et al. |
| 10,357,761 | B2 | 7/2019 | Koseoglu et al. |
| 10,414,991 | B2 | 9/2019 | Umansky et al. |
| 10,934,495 | B2 | 3/2021 | Koseoglu et al. |
| 11,028,332 | B2 | 6/2021 | Koseoglu |
| 11,230,672 | B1 | 1/2022 | Al Herz et al. |
| 11,352,575 | B2 | 6/2022 | Al-Ghrami et al. |

(Continued)

FOREIGN PATENT DOCUMENTS

| | | | |
|---|---|---|---|
| CA | 265464 | A | 11/1926 |
| CN | 1313206 | C | 5/2007 |

(Continued)

OTHER PUBLICATIONS

CN-101768465-B English Translation; Dec. 2014.*
JP-4560749-B2 English Translation; Oct. 2010.*

*Primary Examiner* — Ellen M McAvoy
*Assistant Examiner* — Chantel Graham
(74) *Attorney, Agent, or Firm* — DINSMORE & SHOHL LLP

(57) ABSTRACT

A process for prolonging catalyst activity may comprise contacting heavy hydrocarbon feedstock, wherein the heavy hydrocarbon feedstock is essentially free of residue, and hydrogen with catalyst in a hydroprocessing unit operating at a pressure of greater than or equal to 100 bars. The process may further comprise performing hydrocracking, hydrodesulfurization, and hydrodenitrogenation in a single stage of the hydroprocessing unit to create a hydroprocessed effluent. The process may further comprise regenerating spent catalyst in a catalyst regeneration unit. Additionally, the process may further comprise passing regenerated catalyst back to the hydroprocessing unit without rejuvenating the spent catalyst.

20 Claims, 1 Drawing Sheet

1/1

(56) References Cited

U.S. PATENT DOCUMENTS

| | | | | |
|---|---|---|---|---|
| 11,459,515 | B2 | 10/2022 | Koseoglu | |
| 2005/0274648 | A1 | 12/2005 | Goldstein et al. | |
| 2006/0260981 | A1 | 11/2006 | Gosling | |
| 2007/0217961 | A1 | 9/2007 | Yuan et al. | |
| 2008/0156696 | A1 | 7/2008 | Niccum et al. | |
| 2008/0223754 | A1* | 9/2008 | Subramanian | C10G 69/04 196/14.52 |
| 2011/0079541 | A1 | 4/2011 | Koseoglu | |
| 2018/0346827 | A1 | 12/2018 | Al-Ghamdi et al. | |
| 2020/0269229 | A1 | 8/2020 | Wang et al. | |
| 2020/0362248 | A1 | 11/2020 | Cartolano et al. | |
| 2021/0253959 | A1 | 8/2021 | Koseoglu et al. | |
| 2021/0253962 | A1 | 8/2021 | Hodgkins et al. | |
| 2021/0261869 | A1 | 8/2021 | Koseoglu et al. | |
| 2021/0269724 | A1 | 9/2021 | Hodgkins et al. | |
| 2022/0064543 | A1 | 3/2022 | Al-Ghrami et al. | |
| 2022/0106531 | A1 | 4/2022 | Koseoglu | |
| 2023/0078452 | A1* | 3/2023 | Rokkam | C10G 45/58 585/738 |

FOREIGN PATENT DOCUMENTS

| | | | | |
|---|---|---|---|---|
| CN | 101768465 | B * | 12/2014 | |
| CN | 113423805 | A | 9/2021 | |
| JP | 4560749 | B2 * | 10/2010 | B01J 27/04 |
| RU | 2656273 | C2 | 6/2018 | |
| WO | WO-2011038911 | A1 * | 4/2011 | B01J 23/85 |

* cited by examiner

1/1
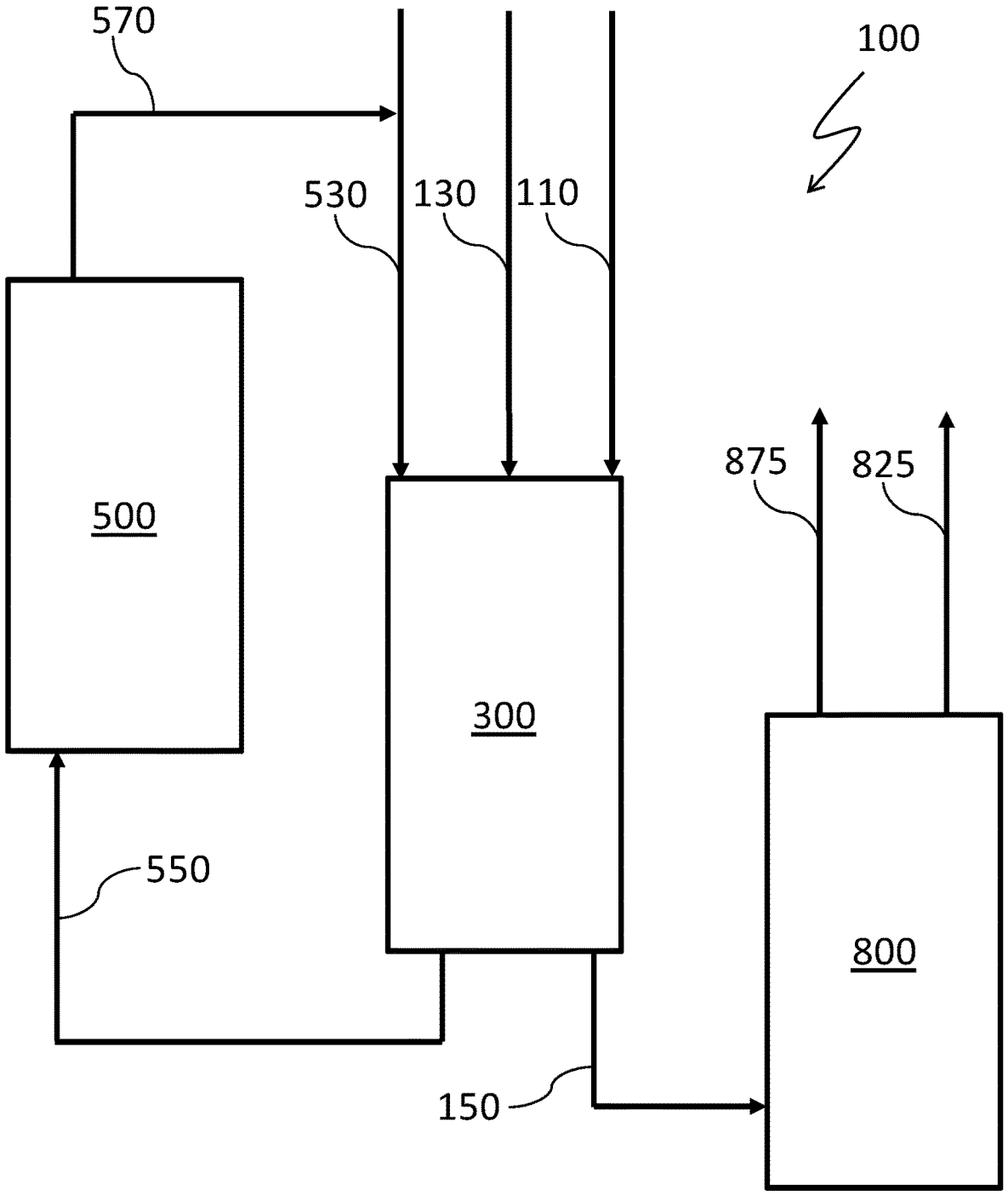

PROCESSES FOR PROLONGING CATALYST ACTIVITY IN A HYDROPROCESSING UNIT

TECHNICAL FIELD

The present disclosure relates to catalysts, to processes for using catalysts, and to processes for maintaining catalysts.

BACKGROUND

Hydrocracking processes are used commercially in a large number of petroleum refineries to process a variety of feedstocks. Generally, hydrocracking processes split large, heavy molecules in the feedstocks into smaller, lighter molecules that have higher average volatility and economic value.

There are two stages in a typical hydrocracking unit: pre-treatment and hydrocracking. In the pre-treatment stage, the feedstock is refined with catalyst to remove impurities such as sulfur and nitrogen. In the hydrocracking stage, the pre-treated feedstock is hydrocracked using catalyst. Although some catalysts are more tolerant of impurities than others, nitrogen and nitrogen byproducts, including ammonia, are poisons to acidic catalysts. For example, zeolite catalysts are acidic catalysts that are particularly susceptible to nitrogen poisoning. Thus, the pre-treatment stage helps prolong the activity of acidic catalysts used for hydrocracking heavy hydrocarbon feeds by removing contaminants from the feedstock that could cause nitrogen poisoning.

Despite the advantages of the pre-treatment stage, needing to process a feedstock in two stages in a hydrocracking unit restricts the reactor capacity and causes a need to shut the reactor down between turnaround and inspection cycles. Therefore, methods are needed to eliminate the need for a pre-treatment step while preventing nitrogen poisoning in catalysts, and in particular, in acidic catalysts.

SUMMARY

Processes according to this disclosure meet this and other needs by providing processes for prolonging catalyst activity while reducing reactor shutdowns. The processes comprise contacting heavy hydrocarbon feedstock, wherein the heavy hydrocarbon feedstock is essentially free of residue, and hydrogen with catalyst in a hydroprocessing unit operating at a pressure of greater than or equal to 100 bars. The process further comprises performing hydrocracking, hydrodesulfurization, hydrodenitrogenation in a single stage of the hydroprocessing unit to create a hydroprocessed effluent. The processes further comprise regenerating spent catalyst in a catalyst regeneration unit and passing regenerated catalyst back to the hydroprocessing unit without rejuvenating the spent catalyst.

These and other features, aspects, and advantages of the present invention will become better understood with reference to the following description and the appended claims.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

FIG. 1 shows an example process according to the processes described herein.

DETAILED DESCRIPTION

Reference will now be made in detail to processes that comprise contacting heavy hydrocarbon feedstock, wherein the heavy hydrocarbon feedstock is essentially free of residue, and hydrogen with catalyst in a hydroprocessing unit operating at a pressure of greater than or equal to 100 bars. The processes further comprises performing hydrocracking, hydrodesulfurization, hydrodenitrogenation in a single stage of the hydroprocessing unit to create a hydroprocessed effluent. Additionally, the process further comprises regenerating spent catalyst in a catalyst regeneration unit. The process also further comprises passing regenerated catalyst back to the hydroprocessing unit without rejuvenating the spent catalyst.

Unless otherwise defined, all technical and scientific terms used herein have the same meaning as commonly understood by one of ordinary skill in the art to which the invention belongs. The terminology used in the description herein is for describing particular embodiments only and is not intended to be limiting. As used in the specification and appended claims, the singular forms "a," "an," and "the" are intended to include the plural forms as well, unless the context clearly indicates otherwise.

As used in the present disclosure, "acidic catalyst" refers to catalysts that have acidity and acid strength.

As used in the present disclosure, "hydrocracking" generally refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

As used in the present disclosure, the term "effluent" refers to a stream that is passed out of a reactor, a reaction zone, or a separator following a particular reaction or separation. Generally, an effluent has a different composition than the stream that entered the reactor, reaction zone, or separator. It should be understood that when an effluent is passed to another component or system, only a portion of that effluent may be passed. For example, a slipstream may carry some of the effluent away, meaning that only a portion of the effluent may enter the downstream component or system.

As used in the present disclosure, "heavy hydrocarbon feedstock" refers to a feedstock that boils at or above 300° C.

As used in the present disclosure, the term "catalyst" refers to any substance which increases the rate of a specific chemical reaction, such as hydrocracking, without itself undergoing any permanent chemical change. For example, a catalyst may be used to pre-treat and/or hydrocrack heavy hydrocarbon feedstock.

As used in the present disclosure, the term "spent catalyst" refers to catalyst that has been contacted with reactants at reaction conditions, but has not been regenerated in a regenerator. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration. The spent catalyst may also include catalyst that has a reduced temperature due to contact with the reactants compared to the catalyst prior to contact with the reactants.

As used in the present disclosure, the term "regenerated catalyst" refers to spent catalyst that has been regenerated in a regenerator by oxidation with a gaseous oxygen containing stream. The regenerated catalyst may have less coke compared to spent catalyst and may have greater catalytic activity compared to spent catalyst. The "regenerated catalyst" may have more coke and lesser catalytic activity compared to fresh catalyst that has not passed through a hydroprocessing unit and regenerator.

As used herein, a "reactor" refers to a vessel in which one or more chemical reactions may occur between one or more reactants optionally in the presence of one or more catalysts. For example, a reactor may include one or more of a fixed-bed reactor, an ebullated-bed reactor, a slurry-bed reactor, a moving bed reactor, a continuous stirred tank (CSTR) reactor, or tubular reactors. The reactors may be operated in series, in parallel, or combinations thereof. In some embodiments, multiple reactors may be provided in parallel to facilitate catalyst replacement, catalyst regeneration, or combinations thereof. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

In some examples, acidic catalysts such as the pre-treatment catalysts or the hydrocracking catalysts may be susceptible to nitrogen poisoning. Nitrogen poisoning occurs when nitrogen containing compounds diffuse into the micropores of acidic catalysts. The nitrogen containing compounds are preferentially adsorbed into the acidic sites. The nitrogen atoms conjugate in aromatic rings, which form during ring-opening reactions under hydrocracking reaction conditions. The aromatic rings are prone to be irreversibly adsorbed on the acidic sites. Additionally, these adsorbed nitrogen compounds conduct condensation reactions and hydrogen transfer reactions to form coke deposited on the catalysts. Coke may also form on non-acidic sites of the catalysts as a result of thermal cracking, condensation reactions, or combinations thereof. These reactions eventually lead to the deactivation of the acidic catalysts.

To minimize the deactivation of the catalysts used to hydrocrack heavy hydrocarbon feedstock, many conventional processes subject feedstock to a pre-treatment phase wherein the feedstock is refined to remove nitrogen, sulfur, and other impurities. These processes may include passing the feedstock over a hydrotreating catalyst bed. In some examples, the catalyst in the hydrotreating catalyst bed may be acidic catalyst. In some examples, the catalyst in the hydrotreating catalyst bed may be impurity tolerant catalyst such as amorphous alumina catalysts. The catalyst in the hydrotreating bed may additionally comprise one or more metals. The metals may be active metals. While such processes help to prolong catalyst activity in the catalysts used to hydrocrack heavy hydrocarbon feedstock by preventing nitrogen poisoning in the catalysts, the pre-treatment phase restricts reactor capacity by taking up space in the reactor. Additionally, the use of a pre-treatment phase can require more frequent shutdown of the reactor, especially if the pre-treatment catalyst is an acidic catalyst. Over time, the catalyst used in the pre-treatment step will lose its activity due to nitrogen poisoning, thermal cracking, condensation reactions, or combinations thereof that cause coke to build up on the pre-treatment catalyst. Eventually, the catalyst used in the pre-treatment step will lose so much activity that it will no longer be feasible to use that catalyst and that catalyst will need to be replaced. Replacing the catalyst used for pre-treatment will require shutting down the reactor. Therefore, processes that prolong catalyst activity by catalyst regeneration and recycling and combined pre-treatment and hydrocracking steps are needed.

Referring now to FIG. 1, an example process 100 for prolonging catalyst activity is schematically depicted. The process comprises contacting a heavy hydrocarbon feedstock 110, hydrogen 130, and catalyst 530 in a hydroprocessing unit 300. In the hydroprocessing unit, the heavy hydrocarbon feedstock 110 undergoes hydrocracking, hydrodesulfurization, and hydrodenitrogenation in a single stage of the hydroprocessing unit 300 to produce a hydroprocessed effluent 150. Spent catalyst 550 is removed from the hydroprocessing unit 300 and passed to a catalyst regeneration unit 500, where the spent catalyst 550 is regenerated. Regenerated catalyst 570 is then passed back to the hydroprocessing unit 300. In some embodiments, regenerated catalyst 570 may combined with catalyst 530.

The heavy hydrocarbon feedstock 110 used in the processes described herein may be a heavy hydrocarbon feedstock has not undergone processing to remove nitrogen. The processes described herein do not require alternative nitrogen removal treatment of the heavy hydrocarbon feedstock 110 to replace conventional pre-treatment. Thus, the processes described herein may provide savings in both time and money compared to some conventional hydrocracking processes because processing to remove nitrogen from the feedstock is not needed.

The heavy hydrocarbon feedstock 110 used in the processes described herein may comprise vacuum gas oil, deasphalted oil from a solvent deasphalting process, demetalized oil from a solvent deasphalting process, light coker gas oil from a coker process, heavy coker gas oil from a coker process, light cycle oils from a fluid catalytic cracking (FCC) process, heavy cycle oils from an FCC process, or combinations thereof. The cycle oils may be derived from crude oil, synthetic crude oil, heavy oil, bitumen, shale oil, coal oil, or combinations thereof.

The heavy hydrocarbon feedstock 110 used in the processes described herein is essentially free of residue. As used herein the phrase "essentially free of residue" refers to a feedstock that comprises less than or equal to 500 parts per million by weight (ppmw), 400 ppmw, 300 ppmw. 200 ppmw, or 100 ppmw Cs-asphaltenes. Without being bound by theory, the use of a heavy hydrocarbon feedstock that is essentially free of residue may prolong catalyst activity by preventing residue buildup on the acidic catalyst. If residue builds up on the catalyst, the residue can reduce the surface area of the catalyst that is available to catalyze reactions. With less surface area available to catalyze the reaction, the catalyst will have less activity, and thus it will take longer for a given amount of feedstock to undergo reaction unless other corrective measures are taken.

In some examples, the heavy hydrocarbon feedstock 110 may be a hydrodemetallized heavy hydrocarbon feedstock that has undergone processing in a demetalization reactor. Certain feedstocks contain metals that may be harmful to catalysts. Over time, when a catalyst is contacted with a heavy hydrocarbon feedstock containing harmful metals, the catalyst may become contaminated with these metals and may lose activity. One way to reduce the amount of undesired metals on the catalyst and to restore some or all catalyst activity is by rejuvenation.

Rejuvenation is a process that removes undesired metals from spent catalysts. Rejuvenation typically involves at least one of solvent washing, acid washing, and water washing. For example, the rejuvenation may occur according to any of the processes taught by U.S. Pat. No. 5,906,953, the entirety of which is hereby incorporated by reference in its entirety. Though the goal of rejuvenation is to remove undesired metals, rejuvenation can be damaging to catalysts because it can also remove active metals that are disposed on the surface of the catalyst. Thus, repeated rejuvenation can lead to catalyst deactivation. If the heavy hydrocarbon feedstock 110 first undergoes hydrodemetalization in a hydrodemetalization reactor, the catalyst 530 will not be subjected to the same level of undesirable metals, and will thus be less likely to suffer activity loss due to contamination with undesirable metals. Additionally, since the catalyst 530 will not be subjected to undesirable metals, it will be unnecessary to rejuvenate the catalyst 530, which will prevent active metals from being stripped from the catalyst 530.

In some examples, the hydrodemetalization reactor may be separate from the hydroprocessing unit 300. In some examples, the heavy hydrocarbon feedstock 110 may have undergone prior processing to remove metals before being contacted with the catalyst 530. In some examples, the heavy hydrocarbon feedstock 110 may be a feedstock that comprises less than or equal to 500 parts per million by weight (ppmw), less than or equal to 100 ppmw, less than or equal to 50 ppmw, less than or equal to 10 ppmw, less than or equal to 5 ppmw, less than or equal to 2 ppmw, or even less than or equal to 1 ppmw metals.

In some examples, the catalyst 530 may additionally comprise one or more metals. The metals may be active metals. In some examples, the active metals may comprise metals or combinations of metals selected from IUPAC groups 6, 7, 8, 9, 10, or combinations thereof, of the Periodic Table. In some examples, the active metals may comprise nickel, molybdenum, tungsten, cobalt, or combinations thereof. In some examples, the catalyst 530 may comprise from 1 wt. % to 40 wt. %, from 1 wt. % to 30 wt. %, from 1 wt. % to 20 wt. %, or from 1 wt. % to 10 wt. % active metals based on the total weight of the catalyst 530. The active metals may be deposited on a catalyst support, or the active metals may be incorporated into the catalyst support. The catalyst support may be amorphous or crystalline. The catalyst support may be alumina-based, silica-alumina-based, silica-based, titania-based, titania-silica-based, titania-silicate-based, zeolite-based, or combinations thereof. The type of catalyst support may determine the catalyst type. For example, if the catalyst support is amorphous and alumina-based, the catalyst may be referred to as an amorphous alumina catalyst. In some examples, the catalyst may comprise a catalyst as described in U.S. Pat. No. 11,542,442, the entirety of which is hereby incorporated by reference.

In some examples, the catalyst may be an acidic catalyst. The acidic catalyst may comprise greater than or equal to 1 μmol per gram (μmol/g) acidic sites, or greater than or equal to 10 μmol/g acidic sites, or greater than or equal to 100 μmol/g acidic sites, as determined by infrared (IR) spectroscopic monitoring as disclosed in Emeis, Cornelis A., Determination of integrated molar extinction coefficients for infrared absorption bands of pyridine adsorbed on solid acid catalysts, Journal of Catalysis 141 (1993): 347-354, the entirety of which is hereby incorporated by reference. The acidic sites may be Brønsted acid sites or Lewis acid sites. The acidic catalysts may be amorphous or crystalline. The acidic catalysts may be silica-alumina catalysts, titania catalysts, titania-silica catalysts, titania-silicate catalysts, zeolite catalysts, or combinations thereof.

If the acidic catalyst is a silica-alumina catalyst, the catalyst may comprise less than 100 μmol/g acidic sites, less than 50 μmol/g acidic sites, or even 10 μmol/g acidic sites. If the acidic catalyst is a silica-alumina catalyst, the catalyst may comprise from 1 μmol/g to 100 μmol/g acidic sites, from 1 μmol/g to 50 μmol/g acidic sites, or even from 1 μmol/g to 25 μmol/g acidic sites. If the catalysts is a zeolite catalyst, the catalyst may comprise less than 5000 μmol/g acidic sites, less than 2000 μmol/g acidic sites, or even less than 1000 μmol/g acidic sites. If the catalysts is a zeolite catalyst, the catalyst may comprise from 50 μmol/g to 5000 μmol/g acidic sites, from 75 μmol/g to 2000 μmol/g acidic sites, or even from 100 μmol/g to 1500 μmol/g acidic sites.

In some examples, the catalyst 530 is a zeolite catalyst. The zeolite may be an ultra-stable Y-type (USY) zeolite, a post modified USY zeolite, a zeolite beta (BEA zeolite), a faujasite (FAU) zeolite, an MFI zeolite, or a mordenite (MOR) zeolite.

The catalyst 530 comprises pores. The catalyst 530 may have a total pore volume of from 0.15 cubic centimeters per gram (cc/g) to 1.70 cc/g. In some examples, the catalyst 530 have may have a total pore volume of from 0.15 cc/g to 1.70 cc/g, from 0.5 cc/g to 1.70 cc/g, from 1.0 cc/g to 1.70 cc/g, from 1.5 cc/g to 1.70 cc/g, from 0.15 cc/g to 1.5 cc/g, from 0.15 cc/g to 1.0 cc/g, or from 0.15 cc/g to 0.5 cc/g. The catalyst 530 may have an average pore diameter of from 40 angstroms (Å) to 50 Å. In some examples, the catalyst 530 may have an average pore diameter of from 1 Å to 100 Å, from 10 Å to 90 Å, from 25 Å to 75 Å, from 35 Å to 65 Å, from 40 Å to 60 Å, from 40 Å to 50 Å, from 42 Å to 47 Å, or from 44 Å to 46 Å.

In some examples, the catalyst 530 comprises a total surface area of from 100 square meters per gram ($m^2/g$) to 900 $m^2/g$, from 100 $m^2/g$ to 800 $m^2/g$, from 100 $m^2/g$ to 700 $m^2/g$, from 100 $m^2/g$ to 500 $m^2/g$, from 100 $m^2/g$ to 250 $m^2/g$, from 200 $m^2/g$ to 900 $m^2/g$, from 300 $m^2/g$ to 900 $m^2/g$, from 300 $m^2/g$ to 900 $m^2/g$, from 400 $m^2/g$ to 900 $m^2/g$, from 500 $m^2/g$ to 900 $m^2/g$, or from 750 $m^2/g$ to 900 $m^2/g$.

The catalyst 530 may be present in hydroprocessing unit 300 as a single layer, multiple layers, or combinations thereof. Whether the catalyst is a single layer or multiple layers may depend on the type of reactor or reactors present in the hydroprocessing unit 300. The catalyst 530 may comprise a single catalyst or may be two or more catalyst mixed together. In some examples, the catalyst 530 may comprise one or more different catalysts. In some examples, the catalyst 530 may comprise one or more acidic catalysts. In some examples, the catalyst 530 may comprises one or more catalysts that are not acidic catalysts. In some examples, the catalyst 530 may comprise two or more different acidic catalysts. In some examples, the catalyst 530 may comprise one or more acidic catalysts and one or more catalysts that are not acidic catalysts.

In some examples, the hydroprocessing unit 300 may be a reactor. The reactor may be an ebullated-bed reactor, a fixed-bed reactor, a moving-bed reactor, or combinations thereof. If the reactor is fixed-bed reactor, the reactor may be operated continuously by changing the reactor temperature to compensate for lost catalyst activity until the catalyst reaches its full life cycle. Once the catalyst reaches the full life cycle, the feedstock may be switched to an alternative parallel reactor and the catalyst from the original reactor may be unloaded and regenerated for the next cycle. If the reactor is an ebullated-bed reactor or a moving-bed reactor, the reactor may be operated at varying temperatures and the lost catalyst activity may be compensated for by increasing the temperature so that there is no need to replace the catalyst frequently. Once the catalyst reaches its full cycle, the catalyst may be regenerated and recycled back to the reactor. If the reactor is operated at a constant temperature, the catalyst replacement rate is determined by this deactivation rate. The catalyst can be regenerated regularly on a daily, weekly, monthly or yearly basis.

The hydroprocessing unit 300 may operate at a pressure of greater than or equal to 100 bars. For example, the hydroprocessing unit 300 may operate at a pressure of 100 to 500 bar, 100 to 400 bars, 100 to 350 bars, 100 to 300 bars, 100 to 250 bars, 100 to 200 bars, or 100 to 150 bars. The hydroprocessing unit 300 may operate at a temperature of from 300° C. to 450° C. For example, the hydroprocessing unit 300 may operate at a temperature of from 300° C. to 450° C., from 350° C. to 450° C., from 400° C. to 450° C., from 300° C. to 400° C., or from 300° C. to 350° C. In some examples, the hydroprocessing unit 300 may operate at a constant temperature.

The hydroprocessing unit 300 may operate at liquid hourly space velocity of from 0.5 per hour to 5 per hour. For example, the hydroprocessing unit 300 may operate at liquid hourly space velocity of from 0.5 per hour to 5 per hour, from 1 per hour to 5 per hour, from 2 per hour to 5 per hour, from 3 per hour to 5 per hour, from 4 per hour to 5 per hour, from 0.5 per hour to 4 per hour, from 0.5 per hour to 3 per hour, from 0.5 per hour to 2 per hour, or from 0.5 per hour to 1 per hour.

In some examples, the hydroprocessing unit 300 may comprise at least two reactors in parallel. When the hydroprocessing unit 300 comprises at least two reactors in parallel, one reactor may be closed for repair or for turnaround and inspection while the other reactors continue to operate. Because at least one reactor may be operational while other reactors are closed when the hydroprocessing unit 300 comprises one or more reactors in parallel, the hydroprocessing unit 300 may be operated continuously. Thus, in some examples where the hydroprocessing unit 300 comprises at least two reactors in parallel, contacting the heavy hydrocarbon feedstock 110 with the catalyst 530 will not occur in at least one reactor. In some examples, hydroprocessing units being operated in accordance with the processes described herein may be able to operate continuously for five or more years between turnaround and inspection.

The hydroprocessing unit 300 may perform hydrocracking, hydrodesulfurization, and hydrodenitrogenation in a single stage. By performing hydrocracking, hydrodesulfurization, and hydrodenitrogenation in a single stage, the entire area of the hydroprocessing unit may be used for hydrocracking. Furthermore, by performing hydrocracking, hydrodesulfurization, and hydrodenitrogenation in a single stage, the hydroprocessing unit will not need to be shut down between turnaround and inspection cycles.

Spent catalyst 550 may be regenerated in a catalyst regeneration unit 500. As described above, nitrogen is a poison to acidic catalysts. Thus, catalyst 530 will become spent and poisoned when it performs hydrodenitrogenation, and will lose some or all of its activity. However, the spent catalyst 550 may be regenerated in catalyst regeneration unit 500. Regenerating the spent catalyst 550 may restore some or all of the activity of the catalyst 530. In some examples, regenerated catalyst 570 may comprise 50%, 75%, 85%, 95%, 97%, 98%, or 99% of the activity of the fresh acidic catalyst.

Regenerating the spent catalyst 550 may comprise stripping the spent catalyst 550 to remove any remaining heavy hydrocarbon feedstock 110. For example, remaining heavy hydrocarbon feedstock 110 may be stripped from spent catalyst 550 with steam, a non-reactive gas such as nitrogen, or hydrocarbons, such as pentane or naphtha. The spent catalyst 550 may be stripped at a temperature from 150 to 350° C., from 175 to 325° C., from 200 to 300° C., from 210 to 285° C., or from 220 to 270° C. In some examples, any remaining heavy hydrocarbon feedstock 110 may be stripped from spent catalyst 550 when the spent catalyst 550 comprises greater than or equal to 5%, greater than or equal to 10%, or greater than or equal to 15% heavy hydrocarbon feedstock 110.

Regenerating the spent catalyst 550 may further comprise a combustion step, wherein coke on the spent catalyst 550 is at least partially burned off. The catalyst regeneration unit 500 may comprise a regeneration furnace that combusts the coke on the spent catalyst 550. In some examples, the spent catalyst may comprise greater than or equal to 5 wt. %, greater than or equal to 10 wt. %, greater than or equal to 15 wt. %, greater than or equal to 20 wt. %, greater than or equal to 25 wt. %, greater than or equal to 30 wt. %, greater than or equal to 35 wt. %, or even greater than or equal to 40 wt. % coke content when measured as a percentage of the total weight of the carbon present in the spent catalyst 550 to the total weight of the spent catalyst 550. In some examples, the regenerated catalyst 570 may comprise less than 2% carbon, less than 1.5% carbon, less than 1% carbon, less than 0.95% carbon, or less than 0.9% carbon. In some examples, the combustion step may be performed from between 420 to 480° C. Regenerating the spent catalyst 550 may also comprise a screening step wherein inert ceramic balls that may be present in the reactor are removed from the spent catalyst 550 when the spent catalyst 550 is unloaded from the hydroprocessing unit 300.

The catalyst regeneration unit 500 may operate at a temperature from 200 to 900° C., from 300 to 850° C., from 350 to 800° C., or from 400 to 750° C. to regenerate the spent catalyst 550. The catalyst regeneration unit 500 may operate at a pressure from 0 to 5 bars, from 0.001 to 4 bars, from 0.01 to 3.5 bars, or from 0.1 to 3 bars, measured as gauge pressure. In some examples, spent catalyst 550 may be regenerated continuously. In some examples, spent catalyst 550 may be regenerated in batches.

In some examples, active metals in the spent catalyst 550 may be in the sulfide form. Regeneration of the spent catalyst 550 may convert at least a portion of the metal sulfides to metal oxides. The conversion of at least a portion of the metal sulfides to metal oxides may be performed at a temperature of from between 220 to 280° C. After regeneration, the regenerated catalyst 570 may comprise less than 2% sulfur, less than 1.5% sulfur, less than 1% sulfur, less than 0.8% sulfur, or less than 0.5% sulfur. After regeneration, the regenerated catalyst 570 may comprise less than 2% nitrogen, less than 1.5% nitrogen, less than 1% nitrogen, less than 0.8% nitrogen, or less than 0.5% nitrogen.

The regenerated catalyst 570 may comprise less than 5 weight percent (wt. %), less than 3 wt. %, less than 2 wt. %, less than 1 wt. %, or less than 0.95 wt. % carbon. The regenerated catalyst 570 may comprise less than 2 wt. %, less than 1.5 wt. %, less than 1 wt. %, less than 0.9 wt. %, or less than 0.8 wt % sulfur. Regenerating the spent catalyst 550 may recover greater than or equal to 70%, 75%, 80%, 85%, or 90% of the surface area of the catalyst when measured by determining the surface area recovered to the total surface area of the catalyst. After regeneration, the regenerated catalyst 570 may be passed back to the hydroprocessing unit 300 without rejuvenating the spent catalyst. In some examples, the regenerated catalyst 570 may be at least partially combined with catalyst 530 as the regenerated catalyst 570 is being passed back to the hydroprocessing unit 300.

In some examples, the daily amount of catalyst 530 added to the hydroprocessing unit 300 each day may be based on catalyst deactivation. For example, the amount of catalyst deactivation could be determined and used to calculate the daily amount of catalyst 530 to be added to the hydroprocessing unit 300. In some examples, the daily amount of catalyst 530 added to the hydroprocessing unit 300 may be from 0.1 kg of catalyst per barrel of heavy hydrocarbon feed processed (kg/bbl) to 1 kg/bbl. In some examples, the daily amount of catalyst 530 added to the hydroprocessing unit 300 may be from 0.1 kg/bbl to 1 kg/bbl, from 0.1 kg/bbl to 0.8 kg/bbl, from 0.1 kg/bbl to 0.5 kg/bbl, from 0.1 kg/bbl to 0.3 kg/bbl, from 0.1 kg/bbl to 0.2 kg/bbl, from 0.2 kg/bbl to 1 kg/bbl, 0.3 kg/bbl to 1 kg/bbl, from 0.5 kg/bbl to 1 kg/bbl, or from 0.8 kg/bbl to 1 kg/bbl. In some examples, the daily amount of catalyst 530 added to the hydroprocessing unit 300 may be 2.5% of the total inventory per 1° C. of catalyst deactivation per month.

In some examples, the spent catalyst 550 may be regenerated according to G. Berrebi, P. Dufresne and Y. Jacquier, Recycling of spent hydroprocessing catalysts: EURECAT technology, Resources Conservation and Recycling 10 (1994): 1-9, the entirety of which is hereby incorporated by reference.

The hydrogen 130 may be contacted with the heavy hydrocarbon feedstock 110 and the catalyst 530 by feeding the hydrogen 130 directly into the hydroprocessing unit 300 (not shown), or by contacting the hydrogen 130 with the heavy hydrocarbon feedstock 110 prior to feeding the heavy hydrocarbon feedstock 110 into the hydroprocessing unit 300. If the hydrogen 130 is fed directly into the hydroprocessing unit 300, the hydrogen 130 may be in the gas phase. If the hydrogen 130 is contacted with the heavy hydrocarbon feedstock 110 prior to feeding the heavy hydrocarbon feedstock 110 into the hydroprocessing unit 300, the hydrogen 130 may be dissolved in the heavy hydrocarbon feedstock 110. If the hydrogen 130 is fed directly into the hydroprocessing unit 300, then the hydroprocessing unit 300 will be a three-phase reactor, as the catalyst 530 will be in a solid state, the heavy hydrocarbon feedstock 110 will be in a liquid state, and the hydrogen 130 will be in a gas state. If the hydrogen 130 is first contacted with the heavy hydrocarbon feedstock 110 before the heavy hydrocarbon feedstock 110 is fed into the hydroprocessing unit 300, then the hydroprocessing unit 300 will be a two-phase reactor, as the catalyst 530 will be in a solid state, the heavy hydrocarbon feedstock 110 will be in a liquid state, and the hydrogen 130 will be dissolved in the heavy hydrocarbon feedstock 110. Advantages of utilizing two-phase reactors include eliminating the need to recover and compress excess hydrogen gas for recycling. Additionally, utilizing two-phase reactors prevents gas holdup in the reactor.

The hydrogen 130 to heavy hydrocarbon feedstock 110 ratio may be from 500 standard liters per liter (StLt/Lt) to 2500 StLt/Lt. For example, the hydrogen 130 to heavy hydrocarbon feedstock 110 ratio may be from 500 StLt/Lt to 2500 StLt/Lt, from 500 StLt/Lt to 2000 StLt/Lt, from 500 StLt/Lt to 1500 StLt/Lt, from 500 StLt/Lt to 1000 StLt/Lt, from 100 StLt/Lt to 2500 StLt/Lt, from 1500 StLt/Lt to 2500 StLt/Lt, or from 2000 StLt/Lt to 2500 StLt/Lt.

The hydroprocessed effluent 150 may comprise less than or equal to 1000 ppmw, less than or equal to 500 ppmw, less than or equal to 100 ppmw, less than or equal to 50 ppmw, or even less than or equal to 10 ppmw sulfur. The hydroprocessed effluent 150 may comprise less than or equal to 500 ppmw, less than or equal to 100 ppmw, less than or equal to 50 ppmw, less than or equal to 10 ppmw, less than or equal to 5 ppmw, less than or equal to 2 ppmw, or even less than or equal to 1 ppmw nitrogen.

In some examples, the hydroprocessed effluent 150 may be introduced to a separation unit 800, which separates the hydroprocessed effluent 150 to produce a plurality of separated effluents that comprise at least a greater boiling point effluent 825 and a lesser boiling point effluent 875. In some examples, the separation unit 800 may separate the hydroprocessed effluent 150 into light gases, naphtha, kerosene, diesel, and unconverted oil. In some examples, the lesser boiling point effluent 875 may comprise from 10 wt. % to 90 wt. %, from 20 wt. % to 80 wt. %, from 25 wt. % to 75 wt. %, from 35 wt. % to 65 wt. %, or 50 wt. % of the hydroprocessed effluent 150. For example, the hydroprocessed effluent 150 may be separated in the separation unit 800 to produce a greater boiling point effluent 825 and a lesser boiling point effluent 875 wherein the greater boiling point effluent 825 comprises 25 wt. % of the weight of the hydroprocessed effluent 150 and the lesser boiling point effluent 875 comprises 75 wt. % of the weight of the hydroprocessed effluent 150.

In some examples, the separation unit 800 may be a vapor-liquid separator, such as a flash drum (sometimes referred to as a breakpot, knock-out drum, knock-out pot, compressor suction drum, or compressor inlet drum), a high-pressure separator, a distillation unit, a fractional distillation unit, a condensing unit, a stripper, a quench unit, a debutanizer, a de-propanizer, a de-ethanizer, or combinations of these. In embodiments where the separation unit 800 is a vapor-liquid separator, the lesser boiling point effluent 875 may exit the separation unit 800 as a vapor and the greater boiling point effluent 825 may exit the separation unit 800 as a liquid. The separation unit 800 may be operated at a temperature suitable to separate the hydroprocessed effluent 150 into at least the greater boiling point effluent 825 and the lesser boiling point effluent 875. In embodiments, the separation unit 800 may be operated at a temperature of from 200 degrees Celsius (° C.) to 500° C. For example, the separation unit 800 may be operated at a temperature of from 200° C. to 450° C., from 200° C. to 400° C., from 200° C. to 350° C., from 200° C. to 300° C. from 200° C. to 250° C., from 250° C. to 500° C., from 250° C. to 450° C., from 250° C. to 400° C., from 250° C. to 350° C., from 250° C. to 300° C., from 300° C. to 500° C., from 300° C. to 450° C., from 300° C. to 400° C., from 300° C. to 350° C., from 350° C. to 500° C., from 350° C. to 450° C., from 350° C. to 400° C., from 400° C. to 500° C., from 400° C. to 450° C., or from 450° C. to 500° C.

The greater boiling point effluent 825 and the lesser boiling point effluent 875 may undergo further processing. In some examples, at least a portion of the greater boiling point effluent 825 may be recycled back to the hydroprocessing unit 300 for further processing. In some examples, the greater boiling point effluent 825 may be combined with the heavy hydrocarbon feedstock 110 before the heavy hydrocarbon feedstock 110 is contacted with the catalyst 530.

The present disclosure includes one or more non-limiting aspects. A first aspect includes a process for prolonging catalyst activity. The process includes contacting heavy hydrocarbon feedstock, wherein the heavy hydrocarbon feedstock is essentially free of residue, and hydrogen with catalyst in a hydroprocessing unit operating at a pressure of greater than or equal to 100 bars performing hydrocracking, hydrodesulfurization, and hydrodenitrogenation in a single stage of the hydroprocessing unit to create a hydroprocessed effluent, regenerating spent catalyst in a catalyst regeneration unit, and passing regenerated catalyst back to the hydroprocessing unit without rejuvenating the spent catalyst.

A second aspect includes the first aspect, wherein the catalyst comprises acidic catalyst.

A third aspect includes the first or second aspect, wherein the catalyst comprises zeolite catalyst.

A fourth aspect includes any of the first through third aspects, wherein the heavy hydrocarbon feedstock has not undergone processing to remove nitrogen.

A fifth aspect includes any of the first through fourth aspects, and further includes demetalizing the heavy hydrocarbon feedstock in a demetalization reactor before contacting the heavy hydrocarbon feedstock with the catalyst.

A sixth aspect includes any of the first through fifth aspects, wherein the hydroprocessing unit is a fixed-bed reactor, a moving bed reactor, or an ebullated-bed reactor.

A seventh aspect includes any of the first through sixth aspects, and further incudes dissolving the hydrogen in the heavy hydrocarbon feedstock prior to contacting the crude oil and the hydrogen with the catalyst.

An eighth aspect includes any of the first through seventh aspects, wherein the process does not include rejuvenating the spent catalyst.

A ninth aspect includes any of the first through eighth aspects, wherein the hydroprocessing unit comprises at least two reactors in parallel.

A tenth aspect includes any of the first through ninth aspect, wherein contacting the heavy hydrocarbon feedstock with the catalyst does not occur in at least one reactor.

An eleventh aspect includes any of the first through tenth aspects, and further includes passing the hydroprocessed effluent to a separation unit to produce at least two separated effluents.

A twelfth aspect includes any of the first through eleventh aspects, and further includes recycling at least a portion of at least one separated effluent to the hydroprocessing unit.

A thirteenth aspect includes any of the first through twelfth aspects The process of claim 1, wherein the hydroprocessed effluent comprises less than or equal to 500 ppmw sulfur and less than or equal to 50 ppmw nitrogen.

A fourteenth aspect includes any of the first through thirteenth aspects, wherein the heavy hydrocarbon feedstock comprises vacuum gas oil, deasphalted oil from a solvent deasphalting process, demetalized oil from a solvent deasphaulting process, light coker gas oil from a coker process, heavy coker gas oil from a coker process, light cycle oils from a fluid catalytic cracking (FCC) process, heavy cycle oils from a FCC process, or combinations thereof.

A fifteenth aspect includes any of the first through fourteenth aspects, wherein the catalyst is an amorphous or zeolite-based catalyst.

A sixteenth aspect includes any of the first through fifteenth aspects, wherein the hydroprocessing unit operates at a temperature of from 300° C. to 450° C., at pressure of from 100 bars to 500 bars, at a liquid hourly space velocity from 0.5 per hour to 5 per hour, and a hydrogen to heavy hydrocarbon feedstock ratio from 500 StLt/Lt to 2500 StLt/Lt.

A seventeenth aspect includes any of the first through sixteenth aspects, wherein the catalyst comprises from 1 wt. % to 40 wt. % active metals, has a total pore volume of from 0.15 cc/g to 1.70 cc/g, a total surface area of from 100-900 $m^2/g$, and an average pore diameter of from 40 Å to 50 Å, wherein the active metals are selected from IUPAC groups 6, 7, 8, 9, 10, or combinations thereof, and wherein the active metals are deposited on or incorporated into a catalyst support, wherein the catalyst support is alumina-based, silica-alumina-based, silica-based, titania-based, titania-silica-based, titania-silicate-based, zeolite-based, or combinations thereof.

An eighteenth aspect includes any of the first through seventeenth aspects, wherein the catalyst is regenerated at a temperature form 400° C. to 750° C. and a pressure from 0.1 bars to 3 bars.

A nineteenth aspect includes any of the first through eighteenth aspects, wherein the catalyst is regenerated continuously or in batches.

A twentieth aspect includes any of the first through nineteenth aspects, wherein catalyst is added to the hydroprocessing unit at a rate of from 0.1 kg/bbl to 1 kg/bbl.

Examples

The present invention will be better understood by reference to the following examples, which are offered by way of illustration and which one skilled in the art will recognize are not meant to be limiting.

A series of hydrocracking pilot plant tests were conducted using a mixture of light vacuum gas oils and heavy vacuum gas oils as feedstock. The light vacuum gas oils and the heavy vacuum gas oils had a percent volume to percent volume ratio of 25:75. The properties of the feedstock are shown in Table 1.

TABLE 1

Feedstock Properties

| Property | Unit | Value |
|---|---|---|
| Density at 15.6° C. | g/cc | 0.87 |
| Sulfur | wt% | 2.07 |
| Nitrogen ASTM D-4629 | ppmw | 1154 |
| ASTM D2887 Stimulated Distillation 0 wt. % | ° C. | 334 |
| ASTM D2887 Stimulated Distillation 5 wt. % | ° C. | 375 |
| ASTM D2887 Stimulated Distillation 10 wt. % | ° C. | 389 |
| ASTM D2887 Stimulated Distillation 30 wt. % | ° C. | 424 |
| ASTM D2887 Stimulated Distillation 50 wt. % | ° C. | 453 |
| ASTM D2887 Stimulated Distillation 70 wt. % | ° C. | 488 |
| ASTM D2887 Stimulated Distillation 90 wt. % | ° C. | 535 |
| ASTM D2887 Stimulated Distillation 95 wt. % | ° C. | 553 |
| ASTM D2887 Stimulated Distillation 100 wt. % | ° C. | 587 |

The tests were conducted at a fix hydrogen partial pressure of 135 bars, a temperature of 370° C., 380° C., 390° C., and 400° C., and a liquid hourly space velocity (LHSV) of 1.6 per hour ($h^{-1}$). The operating conditions, process performance, and yields are shown in Table 2. The catalyst was a zeolite containing catalyst with nickel and molybdenum disposed on the catalyst.

TABLE 2

Operating conditions, process performance and yields

| Variable | Condition 1 | Condition 2 | Condition 3 | Condition 4 |
|---|---|---|---|---|
| Operating Conditions | | | | |
| Hydrogen Pressure (bars) | 135 | 135 | 135 | 135 |
| Temperature (° C.) | 370 | 380 | 390 | 400 |
| Hydrogen:Oil Ratio (standard liters per liter) | 864 | 864 | 865 | 889 |
| Liquid Hourly Space Velocity (per hour) | 1.600 | 1.599 | 1.598 | 1.555 |
| Process Performance | | | | |
| Conversion (weight percent) | 28.8 | 34.7 | 45.6 | 58.7 |
| Hydrodesulfurization (weight percent) | 99.6 | 99.9 | 100.0 | 99.9 |
| Hydrodenitrogenation (weight percent) | 99.8 | 99.9 | 99.9 | 99.8 |
| Yields | | | | |
| Gas (weight percent) | 0.49 | 0.85 | 1.66 | 2.62 |
| Naphtha (weight percent) | 2.99 | 4.51 | 9.04 | 13.25 |
| Mid-Distillates (weight percent) | 24.11 | 28.38 | 34.34 | 41.90 |
| Unconverted Oil (weight percent) | 72.41 | 66.26 | 54.96 | 42.22 |
| Total (weight percent) | 100.00 | 100.00 | 100.00 | 100.00 |

Notably, the hydrodesulfurization and hydrodenitrogenation levels were more than 66.6 weight percent (wt. %), indicating that the catalyst is efficient to remove most of sulfur and nitrogen impurities in feedstocks that have not undergone pre-treatment. Additionally, the conversion fraction ranged between 28.8 wt. % and 58.7 wt. %, demonstrating that pre-treating the feedstock is not necessary when using the processes described herein. The catalyst deactivation rate was 1.26° C. per month.

Unless otherwise defined, all technical and scientific terms used herein have the same meaning as commonly understood by one of ordinary skill in the art to which the invention belongs. The terminology used in the description herein is for describing particular embodiments only and is not intended to be limiting. As used in the specification and appended claims, the singular forms "a," "an," and "the" are intended to include the plural forms as well, unless the context clearly indicates otherwise.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that where a first component is described as "comprising" or "including" a second component, it is contemplated that, in some embodiments, the first component "consists" or "consists essentially of" the second component. Additionally, the term "consisting essentially of" is used in this disclosure to refer to quantitative values that do not materially affect the basic and novel characteristic(s) of the disclosure.

It should be understood that any two quantitative values assigned to a property or measurement may constitute a range of that property or measurement, and all combinations of ranges formed from all stated quantitative values of a given property or measurement are contemplated in this disclosure.

Though particular embodiments have been illustrated and described herein, it will be understood by those skilled in the art that various other changes and modifications may be made without departing from scope of the claimed subject matter. Certain features that are described in this specification in the context of separate embodiments can also be implemented, in combination, in a single embodiment. Conversely, various features that are described in the context of a single embodiment can also be implemented in multiple embodiments, separately, or in any sub-combination. Moreover, although previously described features may be described as acting or being in certain combinations and even initially claimed as such through one or more multiple dependent claim, one or more features from a claimed combination can, in some cases, be excised from the combination, and the claimed combination may be directed to a sub-combination or variation of a sub-combination. It is therefore intended that the appended claims cover all such changes and modifications that are within the scope of the claimed subject matter.

What is claimed is:

1. A process for prolonging catalyst activity, the process comprising:

contacting heavy hydrocarbon feedstock, wherein the heavy hydrocarbon feedstock is essentially free of residue, and hydrogen with catalyst in a hydroprocessing unit operating at a pressure of greater than or equal to 100 bars, performing hydrocracking, hydrodesulfurization, and hydrodenitrogenation in a single stage of the hydroprocessing unit to create a hydroprocessed effluent;

regenerating spent catalyst in a catalyst regeneration unit; and passing regenerated catalyst back to the hydroprocessing unit without rejuvenating the spent catalyst.

2. The process of claim 1, wherein the catalyst comprises acidic catalyst.

3. The process of claim 1, wherein the catalyst comprises zeolite catalyst.

4. The process of claim 1, wherein the heavy hydrocarbon feedstock has not undergone processing to remove nitrogen.

5. The process of claim 1, further comprising demetalizing the heavy hydrocarbon feedstock in a demetalization reactor before contacting the heavy hydrocarbon feedstock with the catalyst.

6. The process of claim 1, wherein the hydroprocessing unit is a fixed-bed reactor, a moving bed reactor, or an ebullated-bed reactor.

7. The process of claim 1, further comprising dissolving the hydrogen in the heavy hydrocarbon feedstock prior to contacting the crude oil and the hydrogen with the catalyst.

8. The process of claim 1, wherein the process does not include rejuvenating the spent catalyst.

9. The process of claim 1, wherein the hydroprocessing unit comprises at least two reactors in parallel.

10. The process of claim 9, wherein contacting the heavy hydrocarbon feedstock with the catalyst does not occur in at least one reactor.

11. The process of claim 1, further comprising passing the hydroprocessed effluent to a separation unit to produce at least two separated effluents.

12. The process of claim 11, further comprising recycling at least a portion of at least one separated effluent to the hydroprocessing unit.

13. The process of claim 1, wherein the hydroprocessed effluent comprises less than or equal to 500 ppmw sulfur and less than or equal to 50 ppmw nitrogen.

14. The process of claim 1, wherein the heavy hydrocarbon feedstock comprises vacuum gas oil, deasphalted oil from a solvent deasphalting process, demetalized oil from a solvent deasphaulting process, light coker gas oil from a coker process, heavy coker gas oil from a coker process, light cycle oils from a fluid catalytic cracking (FCC) process, heavy cycle oils from a FCC process, or combinations thereof.

15. The process of claim 1, wherein the catalyst is an amorphous or zeolite-based catalyst.

16. The process of claim 1, wherein the hydroprocessing unit operates at a temperature of from 300° C. to 450° C., at pressure of from 100 bars to 500 bars, at a liquid hourly space velocity from 0.5 per hour to 5 per hour, and a hydrogen to heavy hydrocarbon feedstock ratio from 500 StLt/Lt to 2500 StLt/Lt.

17. The process of claim 1, wherein the catalyst comprises from 1 wt. % to 40 wt. % active metals, has a total pore volume of from 0.15 cc/g to 1.70 cc/g, a total surface area of from 100-900 $m^2/g$, and an average pore diameter of from 40 Å to 50 Å, wherein the active metals are selected from IUPAC groups 6, 7, 8, 9, 10, or combinations thereof, and wherein the active metals are deposited on or incorporated into a catalyst support, wherein the catalyst support is alumina-based, silica-alumina-based, silica-based, titania-based, titania-silica-based, titania-silicate-based, zeolite-based, or combinations thereof.

18. The process of claim 1, wherein the catalyst is regenerated at a temperature form 400° C. to 750° C. and a pressure from 0.1 bars to 3 bars.

19. The process of claim 1, wherein the catalyst is regenerated continuously or in batches.

20. The process of claim 1, wherein catalyst is added to the hydroprocessing unit at a rate of from 0.1 kg/bbl to 1 kg/bbl.

* * * * *